United States Patent [19]

Sato et al.

[11] Patent Number: 4,548,178

[45] Date of Patent: Oct. 22, 1985

[54] METHOD AND APPARATUS FOR CONTROLLING THE AIR-FUEL RATIO IN AN INTERNAL-COMBUSTION ENGINE

[75] Inventors: Kunihiko Sato; Hiroshi Takahashi, both of Toyota, Japan

[73] Assignee: Toyota Jidosha Kabushiki Kaisha, Toyota, Japan

[21] Appl. No.: 506,832

[22] Filed: Jun. 22, 1983

[30] Foreign Application Priority Data

Nov. 22, 1982 [JP] Japan ..... 57-203721

[51] Int. Cl.[4] ..... F02D 5/02

[52] U.S. Cl. ..... 123/478; 123/480; 123/491

[58] Field of Search ..... 123/491, 486, 480, 478, 123/179 G, 179 L

[56] References Cited

U.S. PATENT DOCUMENTS

| | | | |
|---|---|---|---|
| 3,749,070 | 7/1973 | Oishi et al. | 123/491 |
| 3,898,962 | 8/1975 | Honig et al. | 123/486 |
| 4,184,460 | 1/1980 | Harada et al. | 123/491 |
| 4,266,521 | 5/1981 | Nakano et al. | 123/491 |
| 4,332,226 | 6/1982 | Nomura et al. | 123/478 |

*Primary Examiner*—Andrew M. Dolinar

*Attorney, Agent, or Firm*—Cushman, Darby & Cushman

[57] ABSTRACT

In an internal-combustion engine, when the rotational speed of the engine is lower than a predetermined value, the amount of fuel to be injected into the engine is determined by the coolant temperature thereof. The amount of fuel is also changed in accordance with the change of the opening of a throttle valve provided in an intake-air passage of the engine.

8 Claims, 10 Drawing Figures

| Fig. 2 A | Fig. 2 B |
|---|---|

METHOD AND APPARATUS FOR CONTROLLING THE AIR-FUEL RATIO IN AN INTERNAL-COMBUSTION ENGINE

BACKGROUND OF THE INVENTION

1. Field of the Invention

The present invention relates to a method and apparatus for controlling the air-fuel ratio in an internal-combustion engine.

2. Description of the Prior Art

Generally, in an internal-combustion engine of an electric fuel-injection (EFI) type, during the start of the engine and immediately thereafter, the intake-air amount is so small that it cannot be detected by an airflow meter. As a result, the fuel-injection amount is controlled by the fuel-injection pulse duration dependent upon only the coolant temperature of the engine. In this case, not that such a fuel-injection pulse duration is predetermined on the condition that the accelerator is not operated, i.e., the throttle value is completely closed.

In the above-mentioned engine, however, if the driver operates the accelerator during the start of the engine or immediately thereafter, the intake-air amount is changed in response to the change of the opening of the throttle valve so that the air-fuel ratio is changed. The position of the accelerator during the start of the engine and immediately thereafter is often changed by the driver since the driver operates the accelerator in an internal-combustion engine of a carburetor-type. Therefore, if the air-fuel ratio matches the condition of the accelerator not being operated, operation of the accelerator makes the air-fuel mixture lean and, accordingly, engine speed may not increase as desired and the phenomenon of backfiring may occur. Contrary to this, if the air-fuel ratio matches the condition of the accelerator being operated, non-operation of the accelerator makes the air-fuel mixture rich and, accordingly, the plugs may smoke.

SUMMARY OF THE INVENTION

It is an object of the present invention to provide a method and apparatus for controlling the air-fuel ratio in an internal-combustion engine of an EFI type in which the air-fuel ratio during the start of the engine and immediately thereafter is unchanged even when the opening of the throttle valve is changed.

According to the present invention, the fuel-injection pulse duration determined by the coolant temperature is also changed in accordance with the change of acceleration, i.e., the change of the opening of the throttle valve, thereby diminishing the change of the air-fuel ratio.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
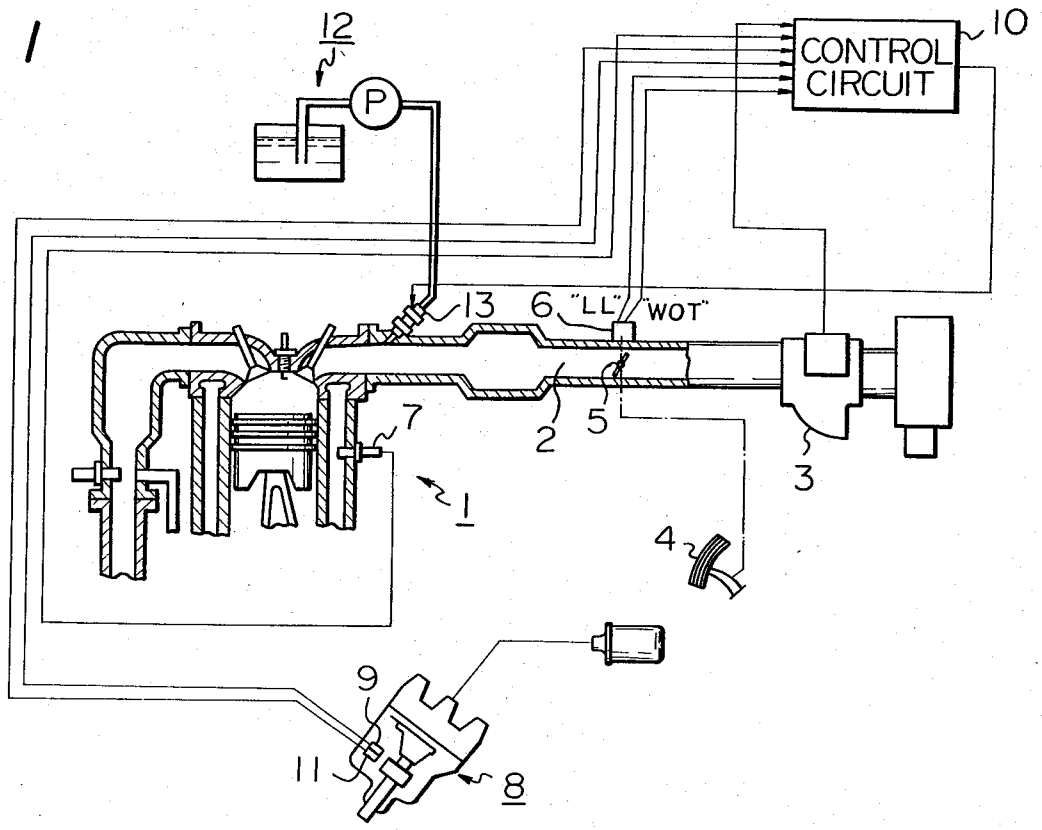
FIG. 1 is a schematic view of an EFI-type internal-combustion engine according to the present invention.

In FIG. 1, reference numeral 1 designates a known four-cycle spark ignition engine disposed in an automotive vehicle. In an intake-air passage 2 of the engine 1, a potentiometer-type airflow meter 3 is provided for detecting the amount of air taken into the engine 1 to generate an analog voltage signal in proportion to the amount of air flowing therethrough. Also provided in the intake-air passage 2 is a throttle valve 5 operated by an accelerator 4, which throttle valve has a throttle sensor 6 at the shaft thereof. The throttle sensor 6 incorporates an idle switch for detecting whether or not the throttle valve 5 is completely closed, i.e., in an idle position, to generate an idle signal "LL", and a wide-open switch for detecting whether or not the throttle valve 5 is completely open, i.e., in a wide-open position, to generate a wide-open signal "WOT".

Disposed in the water jacket of the cylinder block of the engine 1 is a thermistor-type coolant-temperature sensor 7 which detects the engine-coolant temperature to generate an analog voltage signal corresponding to the coolant temperature. Disposed in a distributor 8 are crank-angle sensors 9 and 11 for detecting the angle of the crankshaft (not shown) of the engine 1. In this case, the crank-angle sensor 9 generates a pulse signal at every 720° crank angle (CA), while the crank-angle sensor 11 generates a pulse signal at every 30° CA. The pulse signals of the crank-angle sensors 9 and 11 serve as interrupt-request signals for computing the fuel-injection pulse duration, ignition timing, and the like.

Also provided in the intake-air passage 2 are fuel injectors 13 for supplying pressed fuel from a fuel supply unit 12 to the corresponding intake-air ports of the engine 1.

A control circuit 10 responds to the signals of the airflow meter 3, the coolant-temperature sensor 7, the crank-angle sensors 9 and 11, and the idle switch and the wide-open switch of the throttle sensor 6 to compute the amount of fuel to be injected into the engine 1.

Note that the control circuit 10 may be comprised, for example, of microcomputer.

Figures 2, 2A:
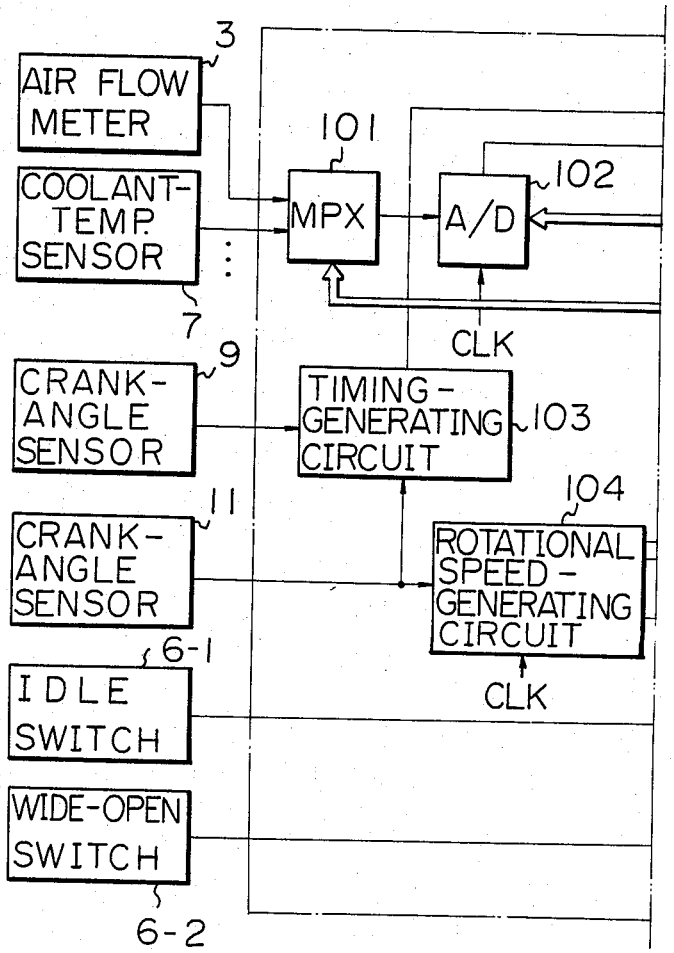
FIGS. 2, 2A and 2B are a block diagram of the control circuit of FIG. 1.
Figure 2B:
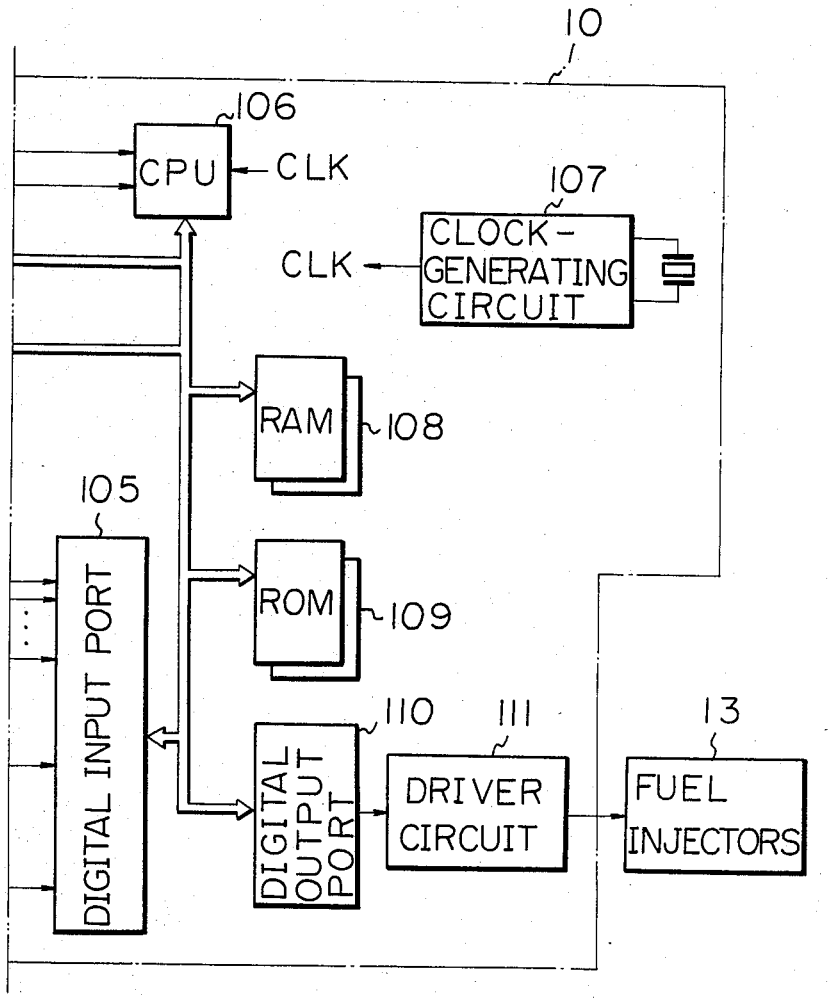

The control circuit 10 is explained in more detail with reference to FIG. 2. In FIG. 2, each analog signal of the airflow meter 3 and the coolant-temperature sensor 7 is supplied via a multiplexer 101 to an analog/digital (A/D) converter 102. That is, the analog signals of the airflow meter 3 and the coolant-temperature sensor 7 are selected by the multiplexer 101, which is controlled by a central processing unit (CPU) 106, and the selected signals are supplied to the A/D converter 102. The A/D converter 102 subjects each analog signal of the airflow meter 3 and the coolant-temperature sensor 7 to A/D conversion by using a clock signal CLK from a clock-generating circuit 107. After each A/D conversion is completed, the A/D converter 102 transmits an interrupt-request signal to the CPU 106. As a result, in an interrupt routine, the CPU 106 successively stores each new piece of data of the airflow meter 3 and the coolant-temperature sensor 7 in predetermined areas of a random-access memory (RAM) 108.

Each digital output signal of the crank-angle sensors 9 and 11 is supplied to a timing-generating circuit 103 for generating interrupt-request signals, reference-timing signals, and the like. Further, the digital output signal of the crank-angle sensor 11 is supplied via a rotational speed-generating circuit 104 to predetermined positions of a digital input port 105. The rotational speed-generating circuit 104 comprises a gate, on and off of which are controlled at every 30° CA, and a counter for counting the number of pulses of the clock signal CLK of the clock-generating circuit 107 when the gate is open. Thus, the rotational speed-generating circuit 104 generates a binary-code signal which is inversely proportional to the rotational speed $N_e$ of the engine 1.

The digital output signals from the idle switch 6-1 and the wide-open switch 6-2 of the throttle sensor 6 are supplied directly to predetermined positions of the digital input port 105.

New rotational speed data $N_e$ and new coolant-temperature data THW at the digital input port 105 are stored in predetermined areas of the RAM 108 by a main routine, a fuel-injection amount computing routine, an ignition-timing computing routine, and the like.

A read-only memory (ROM) 109 stores programs such as the main routine, the fuel-injection amount computing routine, the ignition-timing computing routine, and the like and stores various kinds of fixed data, i.e., contants and map data.

The CPU 106 reads the fuel-injection amount data out of the RAM 108 and transmits it to a predetermined position of a digital output port 110. As a result, a driver circuit 111 activates the fuel injectors 13 for a time period corresponding to the fuel-injection amount at every predetermined operation cycle. For example, the driver circuit 111 comprises a register for receiving the above-mentioned fuel-injection amount data, a down counter for converting a digital signal indicative of the amount of fuel injected, computed by the CPU 106, into a pulse signal having a pulse duration which determines the actual duration of the opening of the fuel injectors 13, and a power amplifier for actuating the fuel injectors 13. Thus, the amount of fuel corresponding to the computed pulse duration is injected into the combustion chamber of the engine 1.

Figure 3:
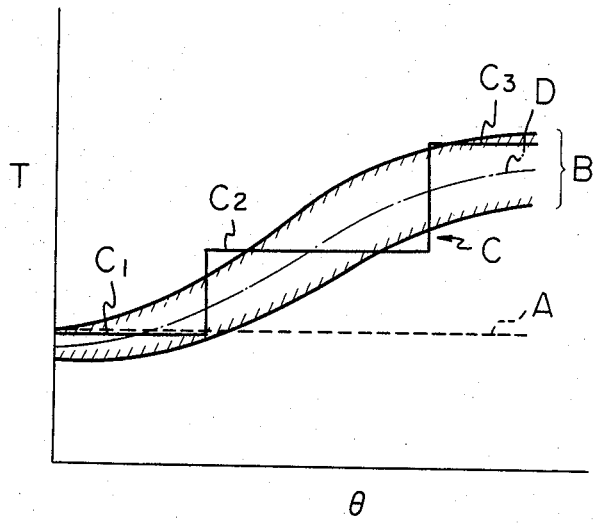
FIG. 3 is a diagram illustrating the characteristics of the engine during the start thereof and immediately thereafter for explaining the principle of the present invention.

In FIG. 3, which illustrates the characteristics of the engine during the start thereof and immediately thereafter, according to the present invention, $\theta$ indicates the opening of the throttle valve 5 and T indicates the pulse duration of a fuel-injection pulse. Here, assume that the coolant temperature THW is definite.

In the prior art, the fuel-injection pulse duration is definite, indicated by the dotted line A. That is, in this case, the air-fuel ratio is optimum on the condition that the accelerator is not operated, i.e., the throttle valve 5 is in the idle position.

The shaded portion B indicates the range in which the air-fuel ratio is optimum in a case where the opening $\theta$ of the throttle valve 5 is changed. That is, if the fuel-injection pulse duration T is definite as in the prior art, the air-fuel mixture becomes lean when the opening $\theta$ of the throttle valve 5 is increased.

In the present invention, when the opening $\theta$ of the throttle valve 5 is changed, the fuel-injection pulse duration T is also changed so as to be close to or within the required range B, thereby obtaining the optinum air-fuel ratio.

In the case where only three distinct levels of the opening of the throttle valve 5 are distinguishable, one approach is to divide the opening $\theta$ of the throttle valve 5 into three steps as indicated by the stepped line C of FIG. 3. In this case, therefore, the fuel-injection pulse duration T is also divided into three steps, as indicated by the lines $C_1$, $C_2$, and $C_3$. In this case, the line $C_1$ corresponds to the state where the throttle valve 5 is in the idle position, the idle switch 6-1 is turned on ("LL"=1), and the wide-open switch 6-2 is turned off ("WOT"=0). In addition, the line $C_2$ corresponds to the state where the throttle valve 5 is in an intermediate position, i.e., the idle switch 6-1 is turned off ("LL"=0) and the wide-open switch 6-2 is also turned off ("WOT"=0). Further, the line $C_3$ corresponds to the state where the throttle valve 5 is in the wide-open position, i.e., the idle switch 6-1 is turned off ("LL"=0) and the wide-open switch 6-2 is turned on ("WOT"=1).

Contrary to the above, linear or continuous opening of the throttle valve 6 is destinguishable, the fuel-injection pulse duration T is set at a middle level as indicated by the curve D within the required range B.

Figure 4:
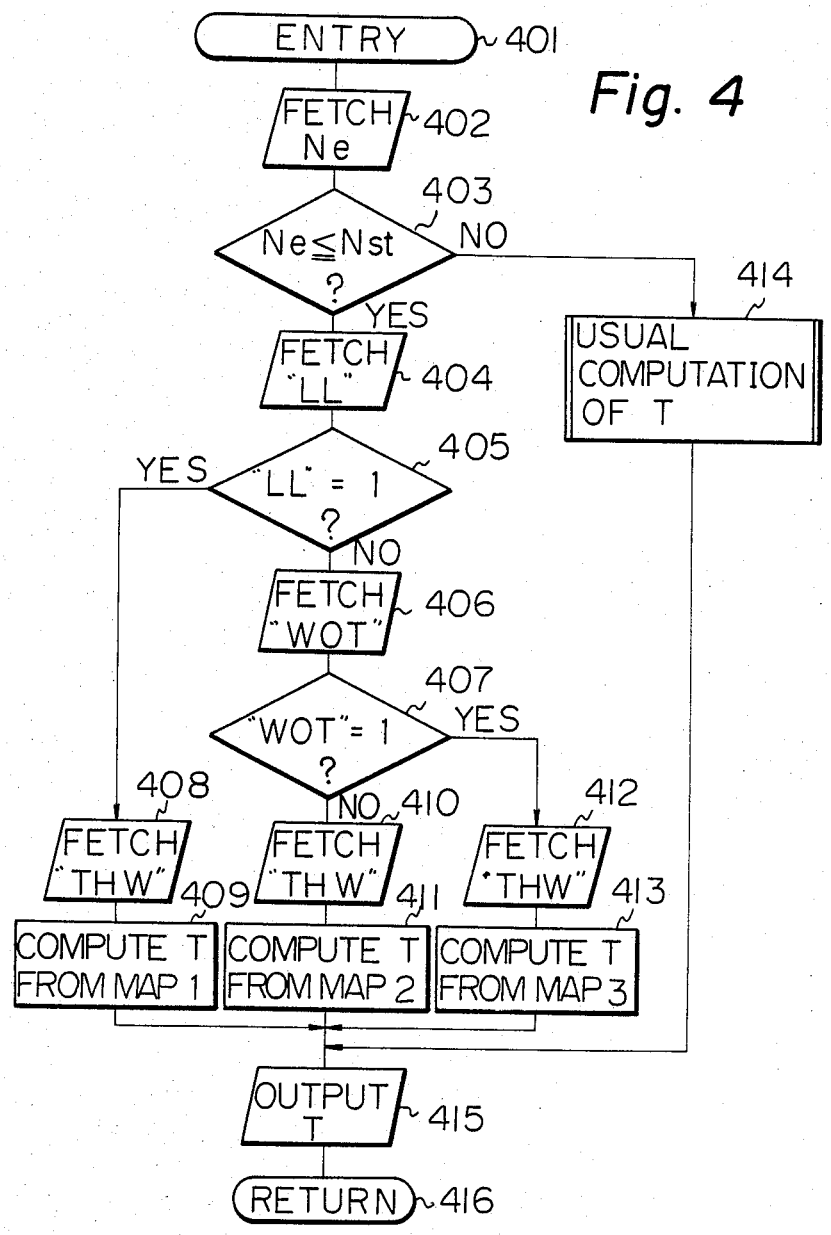
FIGS. 4 through 7 are flow diagrams illustrating the operation of the control circuit of FIG. 1.

FIG. 4 is a flowchart illustrating the operation of the control circuit 10 of FIG. 1, which operation corresponds to the control operation represented by the line C of FIG. 3. In this case, assume that the one-dimensional map of the fuel-injection pulse duration T dependent on the coolant temperature THW is stored in the ROM 109 and, in more detail, that three maps MAP 1, MAP 2, and MAP 3 corresponding to the lines $C_1$, $C_2$, and $C_3$, respectively, are stored in the ROM 109. Of course, the maps MAP 1, and MAP 2, and MAP 3 are one-dimensional maps dependent on the coolant temperature THW.

When the timing-generating circuit 103 transmits an interrupt-request signal to the CPU 106 at every 360° CA, control enters into an interrupt-start step 401 and is then transferred to step 402.

In step 402, the engine rotational speed $N_e$ is fetched, and in step 403, the speed $N_e$ is compared with a predetermined value $N_{st}$.

If the determination at step 403 is YES, i.e., if the engine 1 is in a starting state or in a state immediately thereafter, control is transferred to step 404. Contrary to the above, if the determination at step 403 is NO, i.e., if the engine 1 is in a usual state, control is transferred to step 414.

Note that in step 414 a usual fuel-injection pulse duration is computed. That is, the CPU 106 fetches the intake-air amount data Q and the rotational speed data $N_e$ and computes a basic fuel-injection pulse duration $T_B$ based upon the formula: $T_B = F \times Q/N$, where F is a constant, or based upon a two-dimensional map, dependent upon the data Q and $N_e$, stored in the ROM 109. Further, the CPU 106 compensates the basic fuel-injection pulse duration $T_B$ dependent upon predetermined operating parameters of the engine 1, and thereby a usual fuel-injection pulse duration T is obtained.

In step 404, the idle signal "LL" is fetched, and control is transferred to step 405, in which it is determined whether or not "LL"=1. If the determination at step 405 is YES, control is transferred to step 406, in which the wide-open signal "WOT" is fetched, and control is then transferred to step 407, in which it is determined whether or not "WOT"=1.

Thus, when "LL"=1 and "WOT"=0, i.e., when the throttle valve 5 is in the idle position, control is transferred to step 408, in which the coolant temperature THW is fetched, and control is then transferred to step 409, in which a fuel-injection pulse duration T based upon the map MAP 1 is computed. In addition, when "LL"=0 and "WOT"=0, i.e., when the throttle valve 5 is in an intermediate position, control is transferred to step 410, in which the coolant temperature THW is fetched, and control is then transferred to step 411, in which a fuel-injection pulse duration T based upon the map MAP 2 is computed. Further, when "LL"=0 and "WOT"=1, i.e., when the throttle valve 5 is in the wide-open position, control is transferred to step 412, in which the coolant temperature THW is fetched, and control is then transferred to step 413, in which a fuel-injection pulse duration T based upon the map MAP 3 is computed.

At step 415, the CPU 106 transmits the fuel-injection pulse duration T computed at step 409, 411, 413, or 414 via the digital output port 110 to the driver circuit 111. As a result, the amount of fuel corresponding to the pulse duration T is injected into the combustion chamber of the engine 1.

Figure 5:
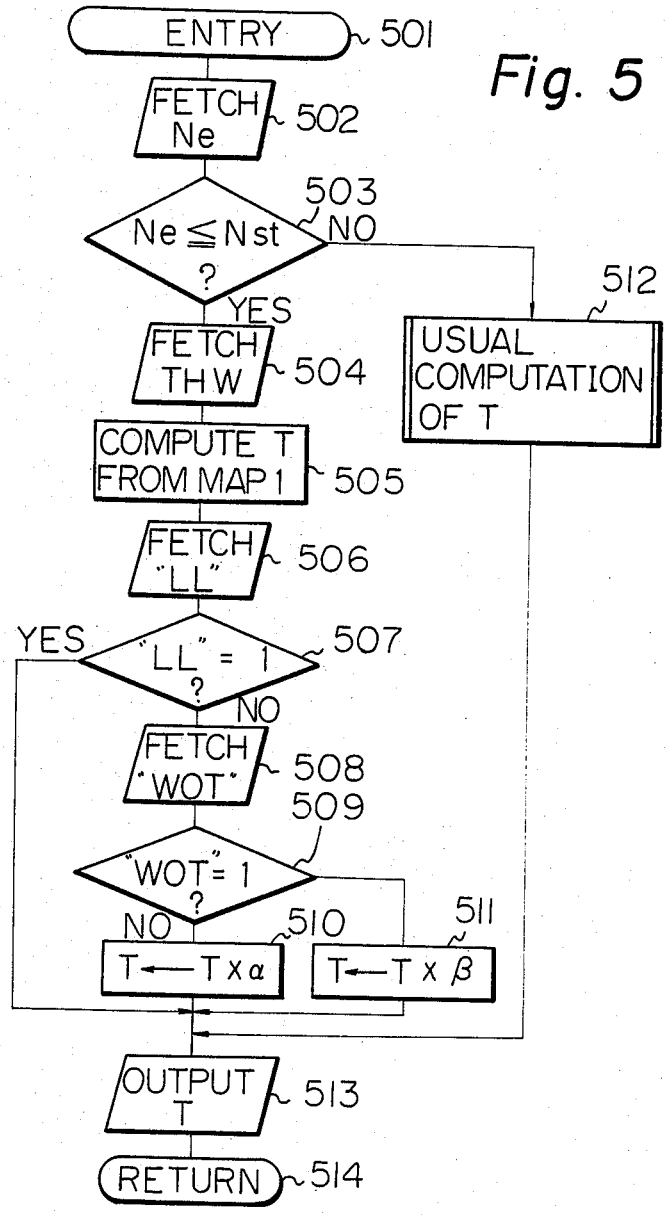

In FIG. 5, only one map, MAP 1, is necessary. Steps 501, 502, 503, 512, 513, and 514 are the same as steps 401, 402, 403, 414, 415, and 416, respectively, of FIG. 4. That is, steps 504 through 511 are provided instead of steps 404 through 413 of FIG. 4.

Steps 504 through 511 are now explained in detail. At step 504, the CPU 106 fetches the coolant temperature THW, and control is transferred to step 505, in which a fuel-injection pulse duration T based upon the map MAP 1, dependent upon the coolant temperature THW, is computed. Then at step 506 the CPU 106 fetches the idle signal "LL", and control is then transferred to step 507, in which it is determined whether or not "LL"=1. If "LL"=1, control is transferred to step 513, but if "LL"=0, control is transferred to step 508, in which the wide-open signal "WOT" is fetched. Next, at step 509, the CPU 106 determines whether or not "WOT"=1. If "WOT"=0, control is transferred to step 510, in which $T \leftarrow T \times \alpha$ is computed. Contrary to this, if "WOT"=1, control is transferred to step 511, in which $T \leftarrow T \times \beta$ is computed.

This is, when the throttle valve 5 is in the idle position ("LL"=1), the CPU 106 outputs the fuel-injection pulse duration T computed at step 505 without any modification of the driver circuit 111. In addition, when the throttle valve 5 is in an intermediate position ("LL"=0 and "WOT"=0), the CPU 106 compensates the fuel-injection pulse duration T at step 510. Further, when the throttle valve 5 is in the wide open position ("WOT"=1), the CPU 106 compensates the fuel-injection pulse duration T at step 111. Note that the compensation coefficients $\alpha$ and $\beta$ should satisfy the condition $1<\alpha<\beta$.

Thus, the operation as illustrated in FIG. 5, which operation necessitates only one map, such as MAP 1, is similar to the operation illustrated in FIG. 4, which operation necessitates three maps such as MAP 1, MAP 2, and MAP 3.

Figure 6:
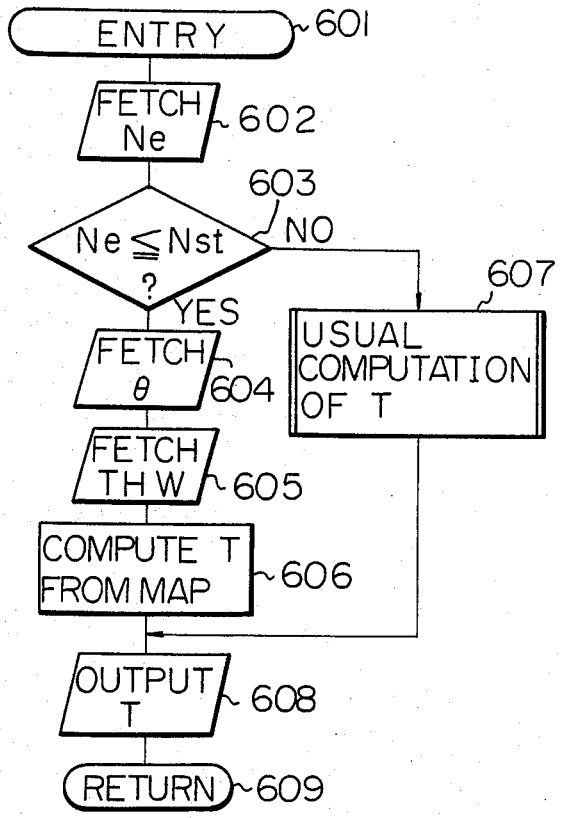

FIG. 6 is a flow chart illustrating the operation of the control circuit 10 of FIG. 2, which operation corresponds to the control operation represented by the curve D of FIG. 3. In this case, for the fuel-injection pulse duration T during the start of the engine 1 and immediately thereafter, a two-dimensional map MAP dependent upon the coolant temperature THW and the opening $\theta$ of the throttle valve 5 is prepared and stored in the ROM 109. In addition, in this case, the throttle sensor 6 of FIG. 1 generates an analog voltage signal dependent upon the opening $\theta$ of the throttle valve 5, which signal is supplied via the multiplexer 101 to the A/D converter 102, not to the digital input port 105.

Steps 601, 602, 603, 607, and 608 are the same as steps 401, 402, 403, 414, and 415, respectively. Therefore, only steps 604, 605, and 606 will be explained. That is, if the determination at step 603 is YES, control is transferred to step 604, in which the opening $\theta$ of the throttle valve 5 is fetched, and then is transferred to step 605, in which the coolant temperature THW is fetched.

Next, at step 606, the CPU 106 computes a fuel-injection pulse duration T by using the opening $\theta$ of the throttle valve 5, computed at step 604, and the coolant temperature THW, based upon the above-mentioned two-dimensional map MAP.

Figure 7:
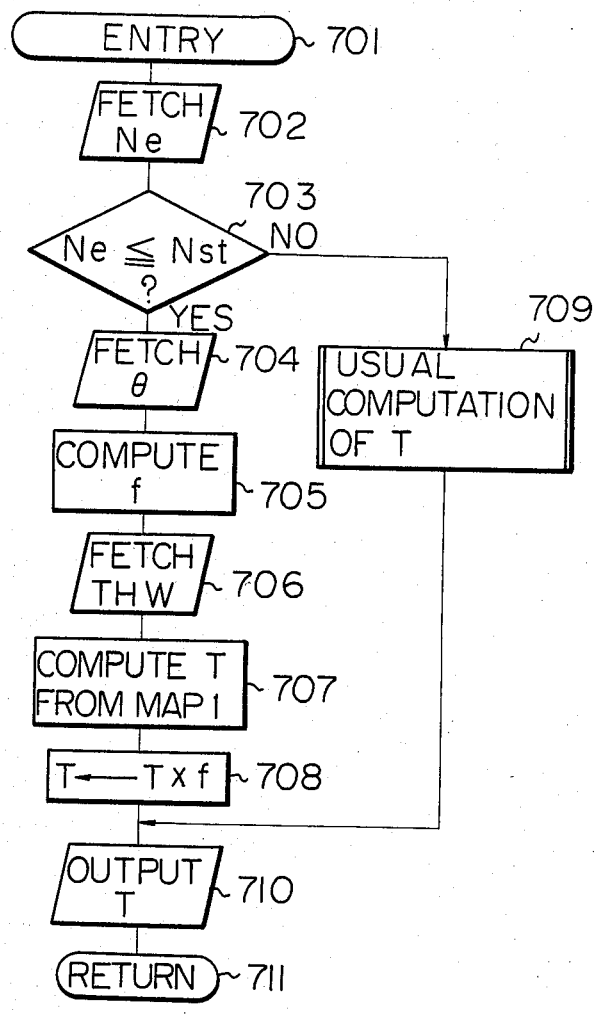

In FIG. 7, steps 701, 702, 703, 709, 710, and 711 are the same as steps 601, 602, 603, 607, 608, and 609, respectively, of FIG. 6. In this case, instead of the two-dimensional map MAP of FIG. 6, there are provided a one-dimensional map of a compensation coefficient f corresponding to the curve D of FIG. 3 and a one-dimensional map of the fuel-injection pulse duration T in a case where the opening $\theta$ of the throttle valve 5 is zero. Note that the latter map is the same as the map MAP 1 of FIG. 4. Therefore, if the determination at step 703 is YES, control is transferred to step 704, in which the opening $\theta$ of the throttle valve 5 is fetched, and then is transferred to step 705, in which a compensation coefficient f is computed by using the opening $\theta$ of the throttle valve 5 based upon the compensation coefficient map. Next, at step 706, the CPU 106 fetches the coolant temperature THW, and control is then transferred to step 707, in which a fuel-injection pulse duration T based upon the map MAP 1 is computed. Thereafter, at step 708, the CPU 106 computes the following: $T \leftarrow T \times f$. That is, the fuel-injection pulse duration T is compensated for by the opening $\theta$ of the throttle valve 5. Thus, the operation as illustrated in FIG. 7 is similar to the operation as illustrated in FIG. 6.

Figure 8:
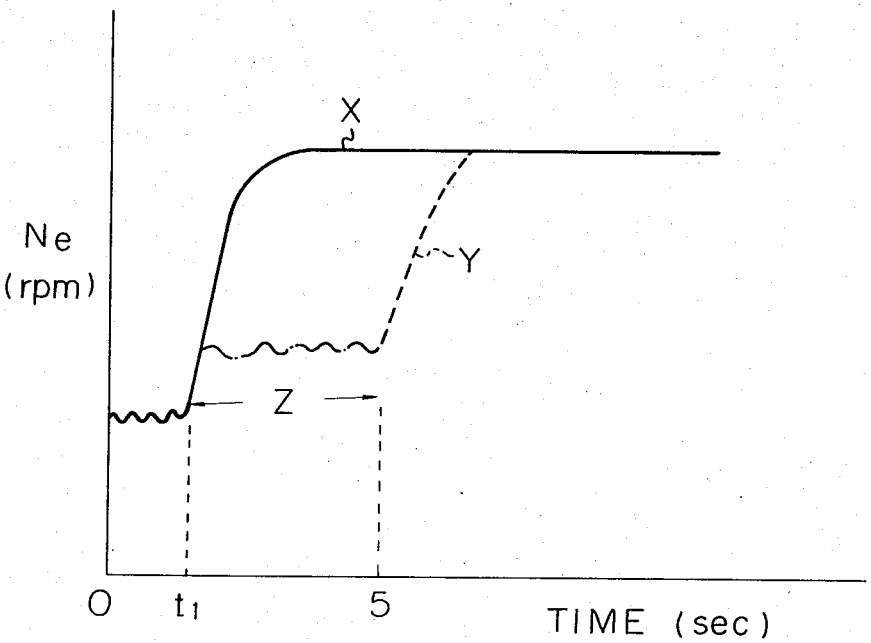
FIG. 8 is a diagram illustrating the characteristics of the rotational speed of the engine according to the present invention.

In FIG. 8, which illustrates the effect of the present invention, the abscissa axis represents the time (sec) while the coordinate axis represents the rotational speed $N_e$ of the engine 1. In addition, the curve X represents the case of the present invention while the curve Y represents the prior art case. That is, in the prior art, when the accelerator is operated at the time $t_1$, the rising of the rotational speed $N_e$ is not sharp, as indicated by Z. Contrary to this, in the present invention, when the accelerator is operated at the time $t_1$, the rising of the rotational speed $N_e$ is sharp.

We claim:

1. A method for controlling the air-fuel ratio in an internal-combustion engine having a throttle valve in an intake-air passage thereof, comprising the steps of:

detecting a plurality of engine operating parameters including the rotational speed and coolant temperature of said engine;

determining whether the detected rotational speed is higher than a predetermined value;

detecting the opening of said throttle valve;

computing a fuel-injection pulse duration depending upon only the coolant temperature and the opening of said throttle valve when the detected rotational speed is lower than or equal to said predetermined value;

computing a fuel-injection pulse duration depending upon said plurality of engine operating parameters when the detected rotational speed is higher than said predetermined value; and injecting the amount of fuel corresponding to said fuel-injection pulse duration into said engine.

2. A method as set forth in claim 1, wherein said opening-detecting step includes the step of detecting the opening of said throttle valve in continuous steps; and wherein said fuel-injection pulse-duration computing step includes the step of computing said fuel-injection pulse duration in continuous steps, depending upon the continuous change of the opening of said throttle valve.

3. A method as set forth in claim 1, wherein said opening-detecting step includes the step of detecting the opening of said throttle valve in discrete steps; and wherein said fuel-injection pulse-duration computing step includes the step of computing said fuel-injection pulse duration in discrete steps, depending upon the discrete change of the opening of said throttle valve.

4. A method as set forth in claim 3, wherein said discrete opening-detecting step includes the steps of:

detecting whether or not said throttle vialve is in an idle position;

detecting whether or not said throttle valve is in a wide-open position;

determining whether or not said throttle vavle is in an intermediate position between said idle position and said wide-open position; and wherein said discrete pulse-duration computing step includes the step of computing said fuel-injection pulse duration depending upon whether said throttle valve is in said idle position, in said wide-open position, or in said intermediate position.

5. An apparatus for controlling the air-fuel ratio in an internal-combustion engine having a throttle valve in an intake-air passage thereof, comprising:

means for detecting a plurality of engine operating parameters including the rotational speed and coolant temperature of said engine;

means for detecting the opening of said throttle valve;

means for: (a) determining whether the detected rotational speed is higher than a predetermined value, (b) computing a fuel-injection pulse duration, depending only upon the coolant temperature and the opening of said throttle valve, when the detected rotational speed is lower than or equal to said predetermined value, and (c) computing a fuel-injection pulse duration depending upon said plurality of engine operating parameters when the detected rotational speed is higher that said predetermined value; and means for injecting the amount of fuel corresponding to said fuel-injection pulse duration into said engine.

6. An apparatus as set forth in claim 5, wherein said opening-detecting means includes means for detecting the opening of said throttle valve in continuous steps; and wherein said fuel-injection pulse-duration computing means computes said fuel-injection pulse duration in continuous steps, depending upon the continuous change of the opening of said throttle valve.

7. An apparatus as set forth in claim 5, wherein said opening-detecting means includes means for detecting the opening of said throttle valve in discrete steps; and wherein said fuel-injection pulse-duration computing means computes said fuel-injection pulse duration in discrete steps, depending upon the discrete change of the opening of said throttle valve.

8. An apparatus as set forth in claim 7, wherein said discrete opening-detecting means includes:

means for detecting whether or not said throttle valve is in a wide-open position;

means for determining whether or not said throttle valve is in an intermediate position between said idle position and said wide-open position; and wherein said pulse-duration computing means computes said fuel-injection pulse duration, depending upon whether said throttle valve is in said idle position, in said wide-open position, or in said intermediate position.

* * * * *